US008657111B2

(12) United States Patent
Anderson et al.

(10) Patent No.: US 8,657,111 B2
(45) Date of Patent: Feb. 25, 2014

(54) GOLF BAG BOTTOMS AND METHODS TO MANUFACTURE GOLF BAG BOTTOMS

(75) Inventors: Douglas W. Anderson, Phoenix, AZ (US); Frank A. Quartarone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 1040 days.

(21) Appl. No.: 12/550,272

(22) Filed: Aug. 28, 2009

(65) Prior Publication Data

US 2009/0314671 A1 Dec. 24, 2009

Related U.S. Application Data

(63) Continuation-in-part of application No. 11/846,424, filed on Aug. 28, 2007, now abandoned.

(60) Provisional application No. 61/228,507, filed on Jul. 24, 2009.

(51) Int. Cl.
*A63B 55/00* (2006.01)

(52) U.S. Cl.
USPC ..... 206/315.3; 248/96; 280/DIG. 6

(58) Field of Classification Search
USPC ..... 206/315.3, 315, 7; 248/96; 280/DIG. 6; D3/255
See application file for complete search history.

(56) References Cited

U.S. PATENT DOCUMENTS

| | | | | |
|---|---|---|---|---|
| 1,384,078 | A | 7/1921 | May | |
| 1,606,113 | A | 11/1926 | Walcott | |
| 1,628,186 | A | 5/1927 | Pierce et al. | |
| 4,942,962 | A | 7/1990 | Jordan | |
| 5,450,955 | A | 9/1995 | Olson | |
| D372,362 | S | 8/1996 | Bryant et al. | |
| D375,203 | S * | 11/1996 | LaPlante, Sr. | D3/320 |
| 6,062,383 | A | 5/2000 | Han | |
| 6,148,998 | A | 11/2000 | Tan | |
| D435,723 | S * | 1/2001 | Shin | D3/255 |
| 6,220,433 | B1 * | 4/2001 | Kang | 206/315.7 |
| 6,298,988 | B1 | 10/2001 | Wen-Chien | |
| 6,299,183 | B1 * | 10/2001 | Kaneko | 280/47.26 |
| 6,598,889 | B1 * | 7/2003 | Su | 280/47.26 |
| 6,648,137 | B2 | 11/2003 | Hamamori | |
| D513,125 | S | 12/2005 | Anderson | |
| 6,976,580 | B2 | 12/2005 | Okuyama et al. | |
| D578,765 | S | 10/2008 | Anderson et al. | |
| 7,832,557 | B2 * | 11/2010 | Amin | 206/315.5 |
| 2002/0096443 | A1 * | 7/2002 | Chang | 206/315.3 |
| 2002/0179466 | A1 | 12/2002 | Maeng | |
| 2003/0234503 | A1 * | 12/2003 | Chiang | 280/47.131 |
| 2004/0200746 | A1 | 10/2004 | Kang | |
| 2005/0161351 | A1 | 7/2005 | Okuyama et al. | |
| 2006/0006085 | A1 | 1/2006 | Fair et al. | |
| 2006/0231435 | A1 | 10/2006 | Rhee | |

FOREIGN PATENT DOCUMENTS

| | | |
|---|---|---|
| EP | 0849139 | 6/1998 |
| EP | 1762279 | 3/2007 |
| JP | 2005185602 | 7/2006 |

* cited by examiner

*Primary Examiner* — Sue A Weaver

(57) ABSTRACT

Embodiments of golf bag bottoms and methods to manufacture golf bag bottoms are generally described herein. Other embodiments may be described and claimed.

30 Claims, 12 Drawing Sheets

GOLF BAG BOTTOMS AND METHODS TO MANUFACTURE GOLF BAG BOTTOMS

CLAIM OF PRIORITY

This application is a nonprovisional of U.S. Patent Application 61/228,507, filed on Jul. 24, 2009, and a continuation-in-part of U.S. patent application Ser. No. 11/846,424, filed on Aug. 28, 2007, and which is now abandoned. The contents of the disclosures listed above are incorporated herein by reference.

TECHNICAL FIELD

The present disclosure relates generally to golf equipment, and more particularly, to golf bag bottoms and methods to manufacture golf bag bottoms.

BACKGROUND

Typically, a golfer may use a golf bag to carry his or her set of golf clubs, golf balls, golf tees, etc. During a round of golf, the golfer may physically carry the golf bag from hole to hole (e.g., via a shoulder strap on the golf bag). Instead of physically carrying the golf bag, the golfer may have an individual (e.g., a caddy) to carry the golf bag. Alternatively, the golfer may use a pull, push, and/or motorized golf cart to carry the golf bag.

DESCRIPTION

Figure 1:
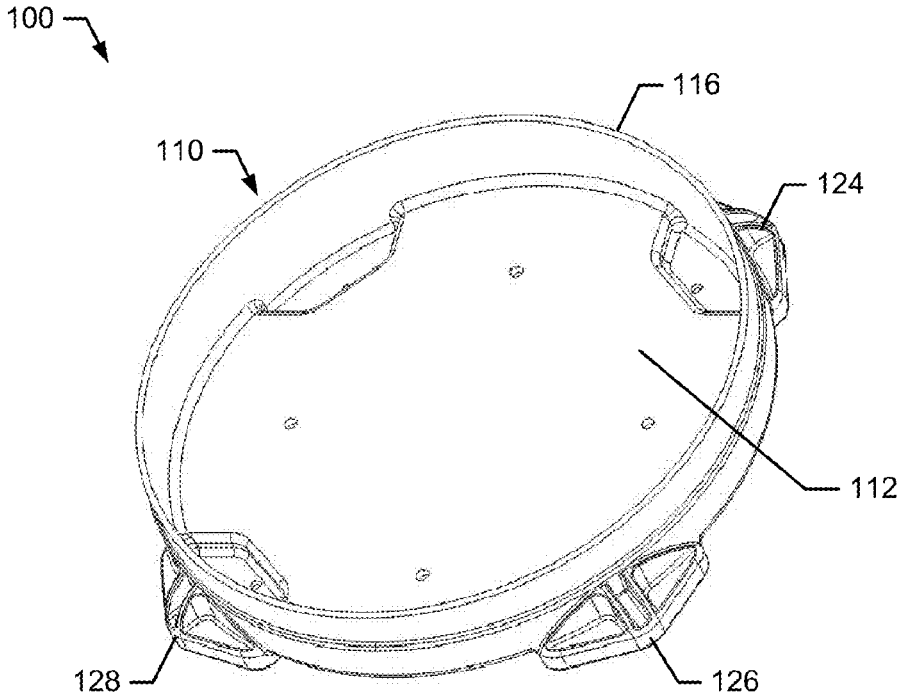
FIG. 1 is a perspective diagram representation of an example golf bag bottom according to an embodiment of the apparatus, methods, and articles of manufacture described herein.

In general, apparatus, methods, and articles of manufacture associated with golf bag bottoms are described herein. The methods, apparatus, and articles of manufacture described herein are not limited in this regard.

In the examples of FIGS. 1-5, a golf bag (e.g., the golf bag 1600 of FIG. 16) may include a golf bag bottom 100. The golf bag bottom 100 may include a base portion 110. The base portion 110 may include an inner surface 112, an outer surface 114, and a side surface 116. For example, the base portion 110 may have a circular shape. The circular shape can be an exact circular shape or a substantially circular shape; and a substantially circular shape can include an oval or an egg shape. Alternatively, the base portion 110 may have a triangular shape, a square shape, a rectangular shape, a pentagonal shape, a hexagonal shape, or any other suitable polygonal shapes. In many examples, the base portion 110 is void of sharp edges and concavities, even when base portion 110 has a polygonal shape.

Figure 2:
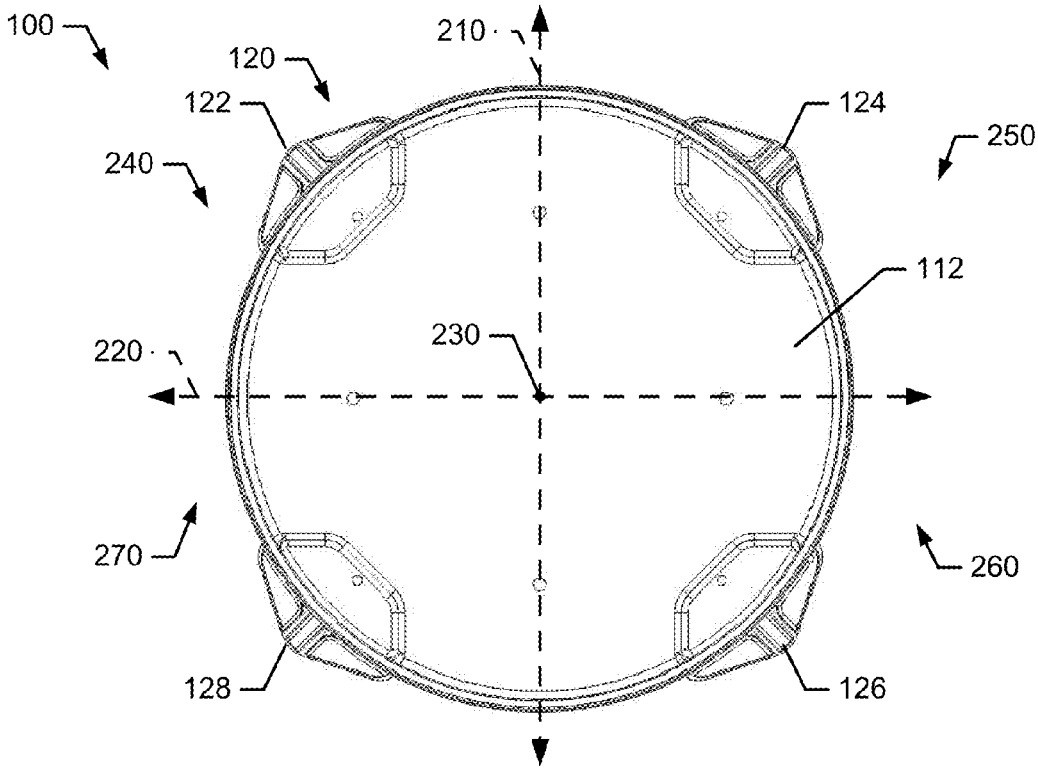
FIG. 2 depicts a top view of the example golf bag bottom of FIG. 1.
Figure 3:
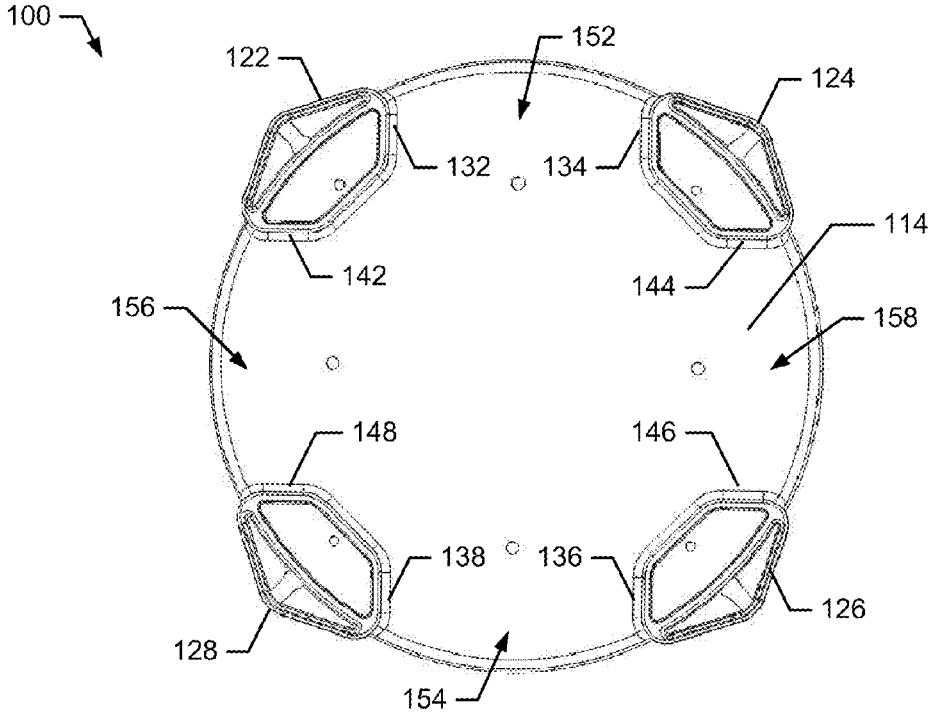
FIG. 3 depicts a bottom view of the example golf bag bottom of FIG. 1.

The golf bag bottom 100 may also include a plurality of support members 120, generally shown as 122, 124, 126, and 128. To provide stability for a golf bag when the golf bag is in a standing position, each of the plurality of support members 120 may be located within a quadrant of the base portion 110. Referring to FIG. 2, for example, the base portion 110 may include a plurality of quadrants defined by a first plane 210 and a second plane 220. The first and second planes 210 and 220 may be substantially perpendicular to each other and intersect at a center 230 of the base portion 110. The base portion 110 may be symmetrical with respect to the first plane 210 and/or the second plane 220. The plurality of quadrants may include a first quadrant 240, a second quadrant 250, a third quadrant 260, and a fourth quadrant 270. In particular, the first support member 122 may be located in the first quadrant 240, the second support member 124 may be located in the second quadrant 250, the third support member 126 may be located in the third quadrant 260, and the fourth support member 128 may be located in the fourth quadrant 270.

One or more of the plurality of support members 120 may be an integral portion of the base portion 110. Alternatively, one or more of the plurality of support members 120 may be coupled to the base portion 110 with a fastener (e.g., a screw-type fastener on an end of the support member). Further, one or more of the plurality support members 120 may be adjustable relative to a ground plane (e.g., the ground plane 410 of FIG. 4). In one example, all of the plurality of support members 120 may be integral portions of the base portion 110. In another example, each of the plurality of support members 120 may be coupled to the base portion 110 with a fastener. In yet another example, the base portion 110 may include a combination of the above examples with one or more of the plurality of support members 120 being an integral portion(s) of the base portion 110 (e.g., 122 and 124) and one or more of the plurality of support members 120 coupled to the base portion 110 with a fastener.

As described in detail below, each of the plurality of support members 120 may extend downwardly and outwardly from the outer surface 114 and/or the side surface 116 within an area between perimeters associated with the base portion 110 (e.g., first and second perimeters 640 and 650 of FIG. 6). Each of the plurality of support members 120 may include at least one substantially flat side (generally shown as 132, 134, 136, 138, 142, 144, 146, and 148) to engage a bag seat member (e.g., the bag seat member of 705 of FIG. 7) associated with a cart (e.g., a pull cart, a push cart, or a motorized cart), a bag stand, a bag rack, etc. For example, the substantially flat sides 132 and 134 may be substantially parallel to each other. Further, the substantially flat sides 136 and 138 may be substantially parallel to each other. In a similar manner, the substantially flat sides 142 and 144 may be substantially parallel to each other, and the substantially flat sides 146 and 148 may be substantially parallel to each other. Alternatively, two or more of the substantially flat sides described herein may not be parallel to each other (e.g., the substantially flat sides 1532 and 1534 of FIG. 15).

Any two of the plurality of support members 120 may form a channel (generally shown as 152, 154, 156, and 158) to receive a bag seat member. In one example, the support members 122 and 124 (e.g., via the substantially flat sides 132 and 134) may form a channel 152 to receive a bag seat member. In another example, the support members 126 and 128 may also form another channel 154 to receive a bag seat member. In a similar manner, the support members 122 and 128 (e.g., the substantially flat sides 142 and 148) and the support members 124 and 126 (e.g., the substantially flat sides 144 and 146) may form channels 156 and 158, respectively, to receive a bag seat member.

Figure 4:
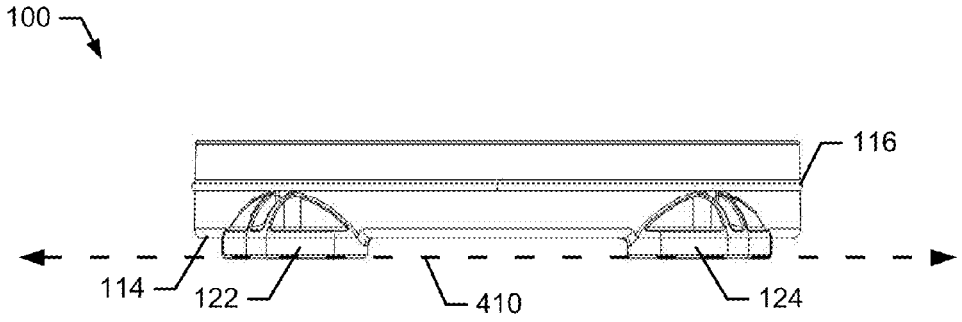
FIG. 4 depicts a side view of the example golf bag bottom of FIG. 1.
Figure 5:
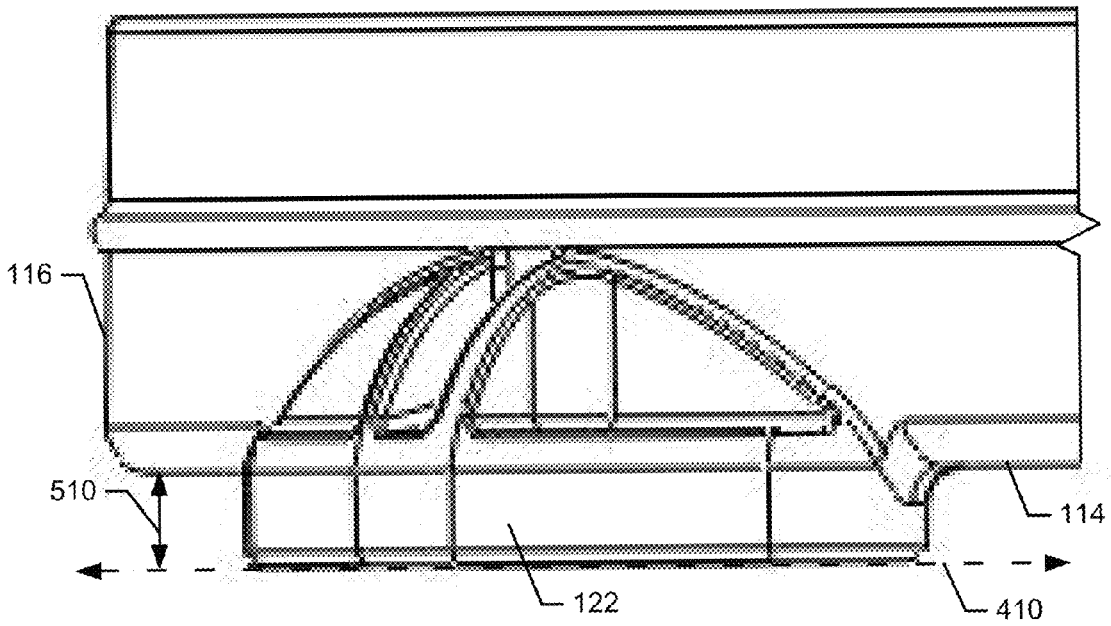
FIG. 5 depicts a side view of a portion of the example golf bag bottom of FIG. 1.
Figure 10:
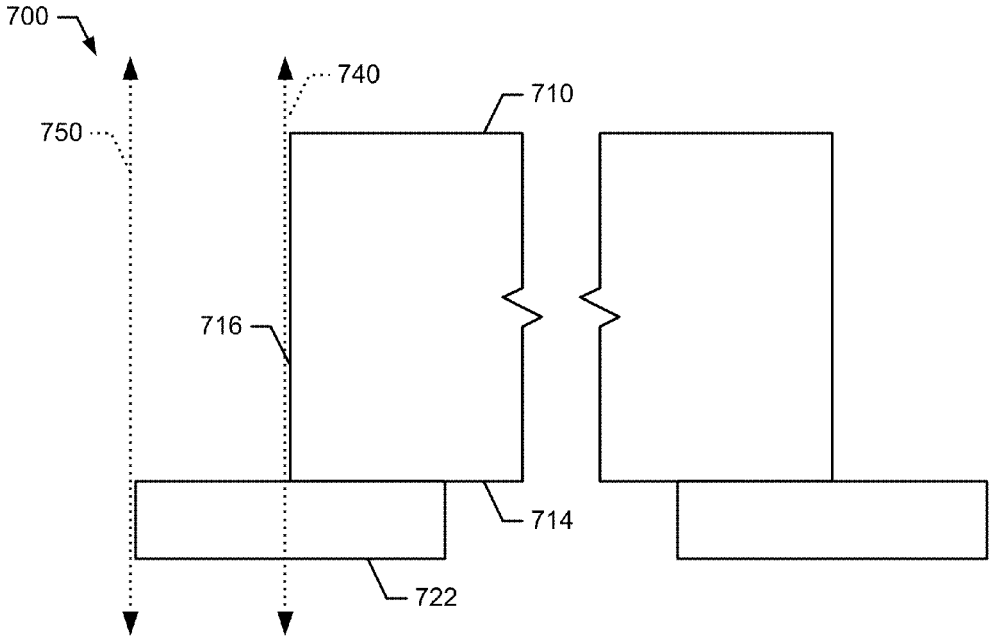
FIG. 10 depicts another cross section view of the example golf bag bottom of FIG. 7.

To provide stability, each of the plurality of support members 120 may also extend outwardly from both the outer surface 114 and the side surface 116. Each of the plurality of support members 120 may include a substantially pentagonal-shaped bottom surface. Referring to FIGS. 4 and 5, for example, the support member 122 may extend downwardly from the outer surface 114 and the side surface 116 to lift up the base portion 110 from a ground plane 410. In particular, the base portion 110 may be lifted up from the ground plane 410 by a distance 510. For example, the distance 510 may be at least 0.81 centimeters (cm). Alternatively as described in detail below, each of the plurality of support members 120 may extend from the outer surface 114 of the base portion 110 only (e.g., as shown in FIG. 10).

Although FIGS. 4 and 5 may depict the outer surface 114 of the bag bottom 100 being on a plane substantially parallel to the ground plane 410, the outer surface 114 may be on a plane that may intersect with the ground plane 410. In one example, the first and second support members 122 and 124 may lift the bag bottom 100 higher from the ground plane 410 than the third and fourth support members 126 and 128.

The golf bag bottom 100 and/or other golf bag bottoms described herein may be made of, for example, plastic entirely or partially. As an example, the plastic of golf bag bottom 100 can be made of polypropylene. One or more portions of the golf bag bottom 100 and/or other golf bag bottoms described herein may also be made of one or more other suitable type of material(s) such as rubber. Alternatively, a first portion of the golf bag bottom 100 may be made of a first material and a second portion of the golf bag bottom 100 may be made of a different material. For example, the base portion 110 may be made of plastic whereas one or more of the plurality of support members 120 may be made of rubber. The material used to make golf bag bottom 100 should be a material that is not brittle, so the material will not break when golf bag bottom 100 is being manufactured. In addition, a material that is not brittle will also help prevent golf bag bottom 100 from breaking when used as part of a golf bag filled with golf clubs. For example, golf bag bottom 100 is less likely to break when the golf bag is set down or dropped. The methods, apparatus, and articles of manufacture described herein are not limited in this regard.

Figure 6:
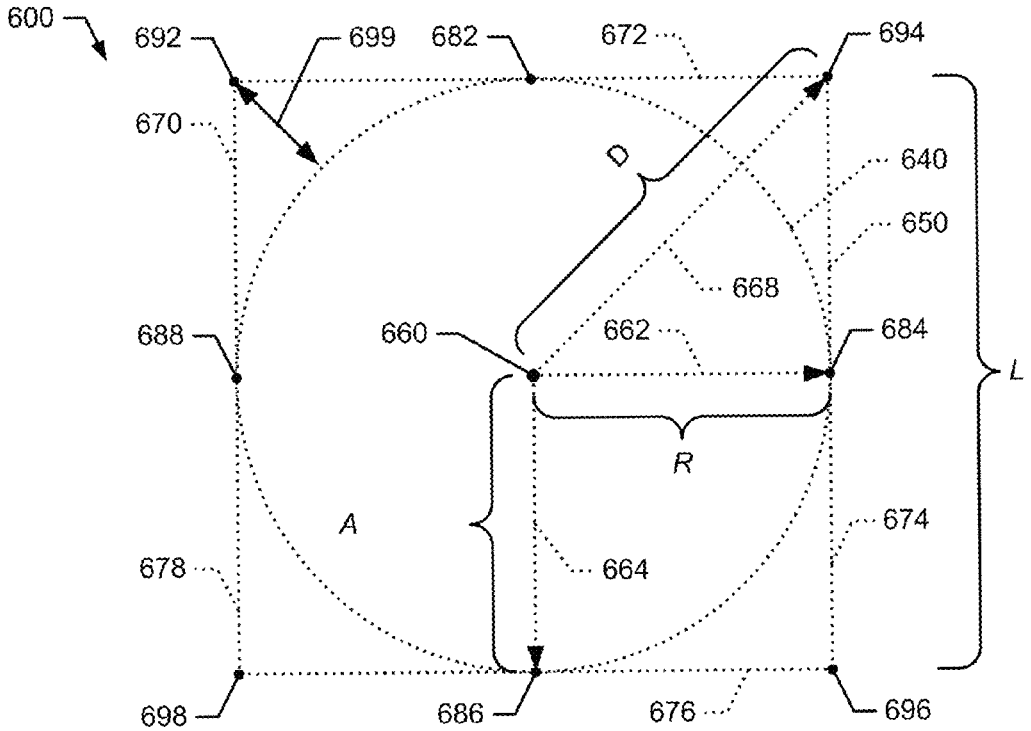
FIG. 6 depicts a bottom view of example perimeters associated with the example golf bag bottom of FIG. 1.

Turning to FIG. 6, for example, the golf bag bottom 100 may be associated with a configuration 600 having a first perimeter 640 and a second perimeter 650. The first and second perimeters 640 and 650 may have a common center 660. In particular, the shape of the base portion 110 may define the first perimeter 640. In one example, the first perimeter 640 may be a substantially circular perimeter. The first perimeter 640 may include a radius 662 with a length of R from the center 660. For example, the radius 660 may be 11.89 cm. Alternatively, the first perimeter 640 may be a polygon (e.g., pentagon, hexagon, heptagon, octagon, etc.) associated with an apothem.

The second perimeter 650 may be based on the first perimeter 640. For example, the second perimeter 650 may be a substantially squared perimeter to inscribe the first perimeter 640. In particular, a plurality of lines 670 tangential to the first perimeter 640 may define the second perimeter 650. The second perimeter 650 may include an apothem 664 with a length of A from the center 660. The radius 662 of the first perimeter 640 and the apothem 664 of the second perimeter 650 may be equal to each other. In one example, the plurality of lines 670 may include four lines 672, 674, 676, and 678 tangential to the first perimeter 640 at four tangential points 682, 684, 686, and 688, respectively. The length of each of the plurality of lines 670 (L) may be twice the length of the radius 662 (e.g., $L=2*R$). The first and third lines 672 and 676 may be parallel to each other, and the second and fourth lines 674 and 678 may also be parallel to each other. The first line 672 may be substantially perpendicular to the second and fourth lines 674 and 678. In a similar manner, the second line 674 may be substantially perpendicular to the first and third lines 672 and 676.

The plurality of lines 670 may define four corner points of the second perimeter 650, generally shown as 692, 694, 696, and 698. In particular, the first and fourth lines 672 and 678 may intersect at the first corner point 692, the first and second lines 672 and 674 may intersect at the second corner point 694, the second and third lines 674 and 676 may intersect at the third corner point 696, and the third and fourth lines 674 and 678 may intersect at the fourth corner point 698.

The center 660 may be a distance 668 (D) from each of the four corner points 692, 694, 696, and 698. In one example, the distance 668 may be the square root of 2 times the radius 662 (e.g., $D=\sqrt{2}*R\approx1.414*R$). Accordingly, the distance 699 between the first and second perimeters 640 and 650 may be in a range between zero and $(\sqrt{2}-1)*R$. In particular, the shortest distance between the first and second perimeters 640 and 650 may be substantially zero at each of the four tangential points 682, 684, 686, and 688 whereas the longest distance between the first and second perimeters 640 and 650 may be substantially $(\sqrt{2}-1)*R$. The methods, apparatus, and articles of manufacture described herein are not limited in this regard.

Although the above examples may depict support members with substantially pentagonal-shaped bottom surfaces, the support members described herein may have other suitable shapes. In the example of FIGS. 7, 8, 9, and 10, a golf bag bottom 700 may include a base portion 710 and a plurality of support members 720, generally shown as 722, 724, 726, and 728. The base portion 710 may include an outer surface 714 and a side surface 716. The base portion 710 may be associated with a first perimeter 740 and a second perimeter 750.

The first and second perimeters 740 and 750 may have a common center 760 with the second perimeter 750 inscribing the first perimeter 740. In particular, the first perimeter 740 may be defined by the shape of the outer surface 714 and/or the side surface 716. The second perimeter 750 may be defined by a plurality of lines tangential to the first perimeter 740, generally shown as 772, 774, 776, and 778. In one example, the first perimeter 740 may be a circle with a radius 762 extending from the center 760. The first perimeter 740 may be substantially equal to the circumference of the outer surface 714 (C) defined by the radius 762 (R) (i.e., $C=2*\pi*R$). The second perimeter 750 may be a square with an apothem 764 (A) extending from the center 760. The apothem 764 may be substantially equal to the radius 762 (i.e., A=R) to inscribe the first perimeter 740. The second perimeter 750 may be substantially equal to eight times the radius 760 (i.e., 8*R).

Each of the plurality of support members 720 extend downwardly from the outer surface 714 of the base portion 710. In particular, each of the plurality of support members 720 may include a substantially squared bottom surface. Further, each of the plurality of support members 720 may include at least one substantially flat side (generally shown as 732, 734, 736, and 738) to engage at least a portion of a bag seat member 705 associated with a cart, a bag stand, a bag rack, etc. (not shown). Any two of the plurality of support members 720 may form a channel 752 to receive the bag seat member 705. In one example, the support members 722 and 724 (e.g., via the substantially flat sides 732 and 734) may form channel 752 to receive the bag seat member 705. The substantially flat sides 732 and 734 may engage at least a portion of the bag seat member 705 in response to the base portion 710 sitting on a top surface (e.g., the top surface 1810 of FIG. 18) of the bag seat member 705 via the outer surface 714. The bag seat member 705 may be associated with a width 707. Accordingly, the substantially flat sides 732 and 734 may be separated from each other by at least a distance of the width 707 of the bag seat member 705.

By engaging at least a portion of the bag seat member 705 with two or more of the plurality of support members 720, two or more substantially flat sides may prevent or reduce movement. In particular, the substantially flat sides 732 and 734 may engage a portion of the bag seat member 705 to prevent or reduce rotational movement of a golf bag (e.g., the golf bag 1700 of FIG. 17) associated with the golf bag bottom 700. Further, for example, the substantially flat sides 732 and 734 may prevent the golf bag from falling off of a cart (e.g., the golf cart 1800 of FIG. 18).

Figure 9:
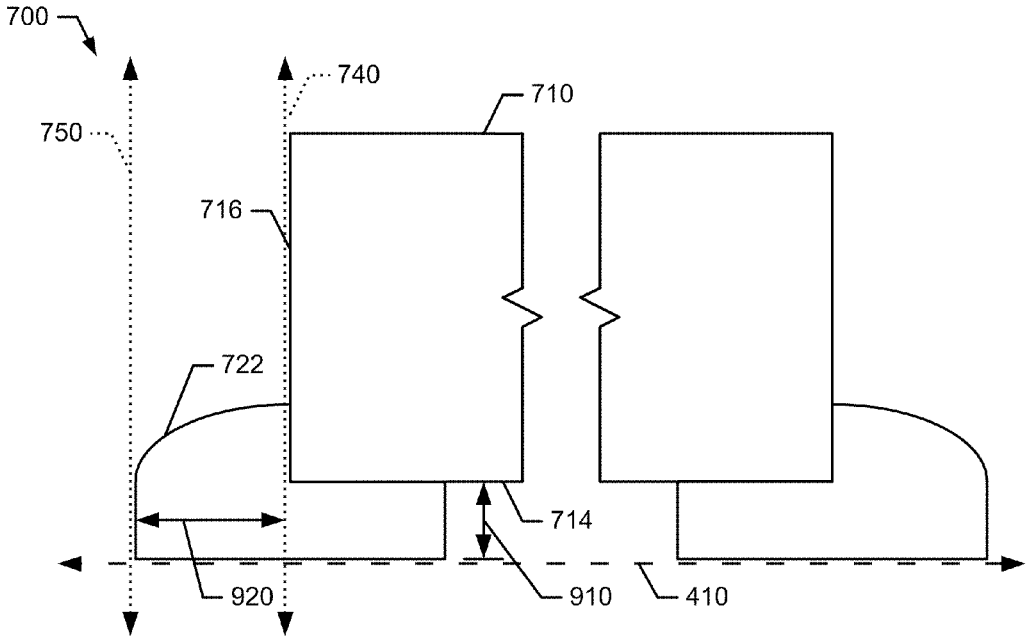
FIG. 9 depicts a cross section view of the example golf bag bottom of FIG. 7 along the line 2-2.

To provide stability, each of the plurality of support members 720 may extend outwardly from the base portion 710 (e.g., via the outer surface 714 and/or the side surface 716). In particular, the golf bag bottom 700 may stabilize a golf bag in a standing position without increasing the size of the base portion 710 (e.g., without increasing the circumference or the surface area of the base portion 710) by defining the first perimeter 740 with the base portion 710 and extending the plurality of support members 720 between the first and second perimeters 740 and 750. Referring to FIG. 9, for example, the support member 722 may extend outwardly from both the outer surface 714 and the side surface 716 between the first and second perimeters 740 and 750. In particular, the support member 722 may extend downwardly from the base portion 710 by a first distance 910 (Y) (e.g., the support member 722 may lift up the base portion 710 from the ground plane 410 by the first distance 910). The support member 722 may extend outwardly from the first perimeter 740 (and/or the side surface 716) by a second distance 920 (X). The second distance 920 may be twice as long as the first distance 910 (e.g., X=2*Y). For example, the first distance 910 may be 0.81 cm and the second distance 920 may be 1.63 cm.

Alternatively as illustrated in FIG. 10, the support member 722 may extend outwardly from the outer surface 714 only between the first and second perimeters 640 and 650. In another example, a first portion of the support member 722 may extend outwardly from both the outer surface 714 and the side surface 716 between the first and second perimeters 740 and 750 (e.g., as shown in FIG. 9) where as a second portion of the support member 122 may extend outwardly from the outer surface 114 only between the first and second perimeters 740 and 750 (e.g., as shown in FIG. 10).

Figure 7:
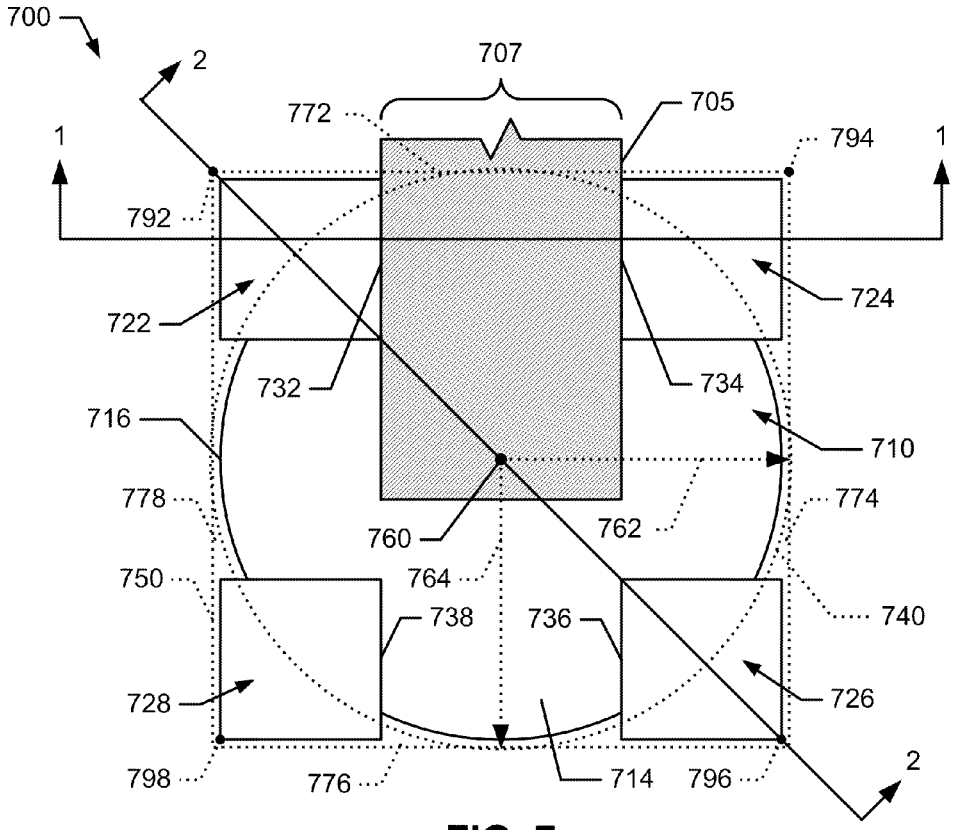
FIG. 7 depicts a bottom view of another example golf bag bottom.
Figure 8:
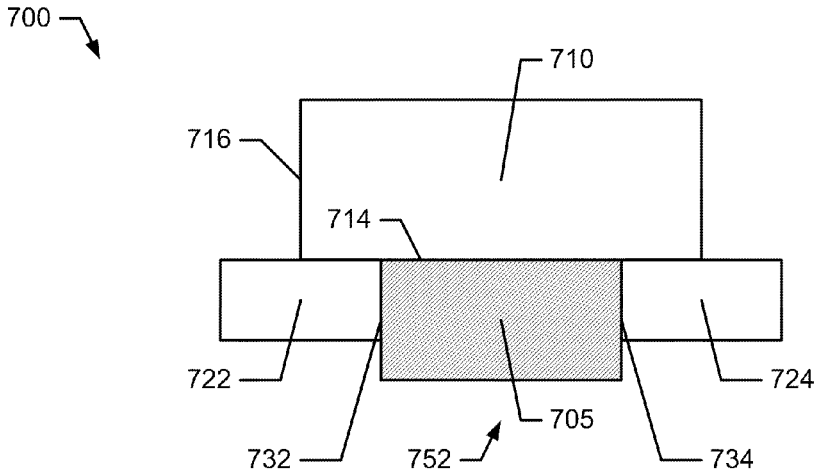
FIG. 8 depicts a cross section view of the example golf bag bottom of FIG. 7 along line 1-1.

While FIGS. 7 and 8 may depict support members with square-shaped bottom surfaces, the support members described herein may be other suitable shapes. Further, although FIG. 7 may depict four support members, the bag bottom 700 may include more or less support members. The methods, apparatus, and articles of manufacture described herein are not limited in this regard.

Figure 11:
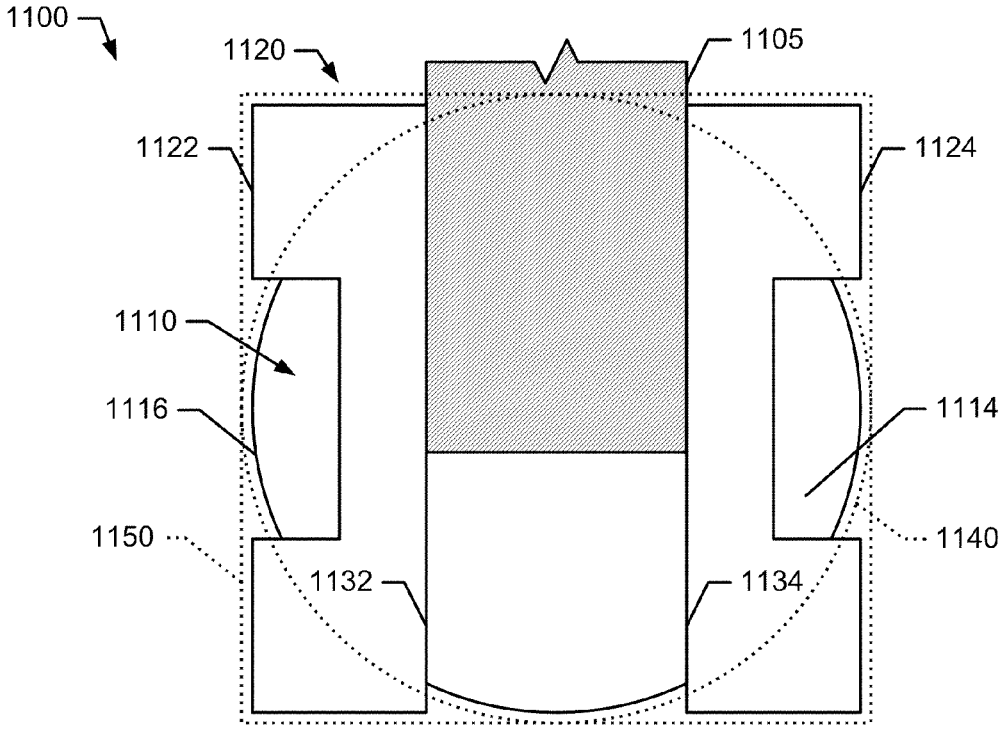
FIG. 11 depicts a bottom view of another example golf bag bottom.

Turning to FIG. 11, for example, a golf bag bottom 1100 may include a base portion 1110 and a plurality of support members 1120 (e.g., generally shown as a first support member 1122 and a second support member 1124). Each of the plurality of support members 1120 may extend downwardly from the base portion 1110 (e.g., via the outer surface 1114). In particular, each of the plurality of support members 1120 may include a U-shaped bottom surface. Further, each of the plurality of support members 1120 may include at least one substantially flat side (e.g., generally shown as a first substantially flat side 1132 and a second substantially flat side 1134). In one example, the first support member 1122 may be associated with the first substantially flat side 1132 where as the second support member 1124 may be associated with the second substantially flat side 1134. The first and second substantially flat sides 1132 and 1134 may form a channel to receive the bag seat member 1105. For example, the first substantially flat side 1132 may engage a first side of a bag seat member 1105 whereas the second substantially flat side 1134 may engage a second side of the bag seat member 1105 in response to the golf bag bottom 1100 sitting on a top surface (e.g., the top surface 1810 of FIG. 18) of the bag seat member 1105.

The base portion 1110 may be associated with a first perimeter 1140 and a second perimeter 1150. Each of the plurality of support members 1120 may extend outwardly from the base portion 1110 (e.g., via the outer surface 1114 and/or the side surface 1116) into an area between the first and second perimeters 1140 and 1150.

Although FIG. 11 may depict U-shaped support members, the plurality of support members 1120 may have other suitable shapes to engage at least a portion of a bag seat member associated with a cart, a bag stand, a bag rack, etc. (e.g., V-shaped support members). The methods, apparatus, and articles of manufacture described herein are not limited in this regard.

Figure 12:
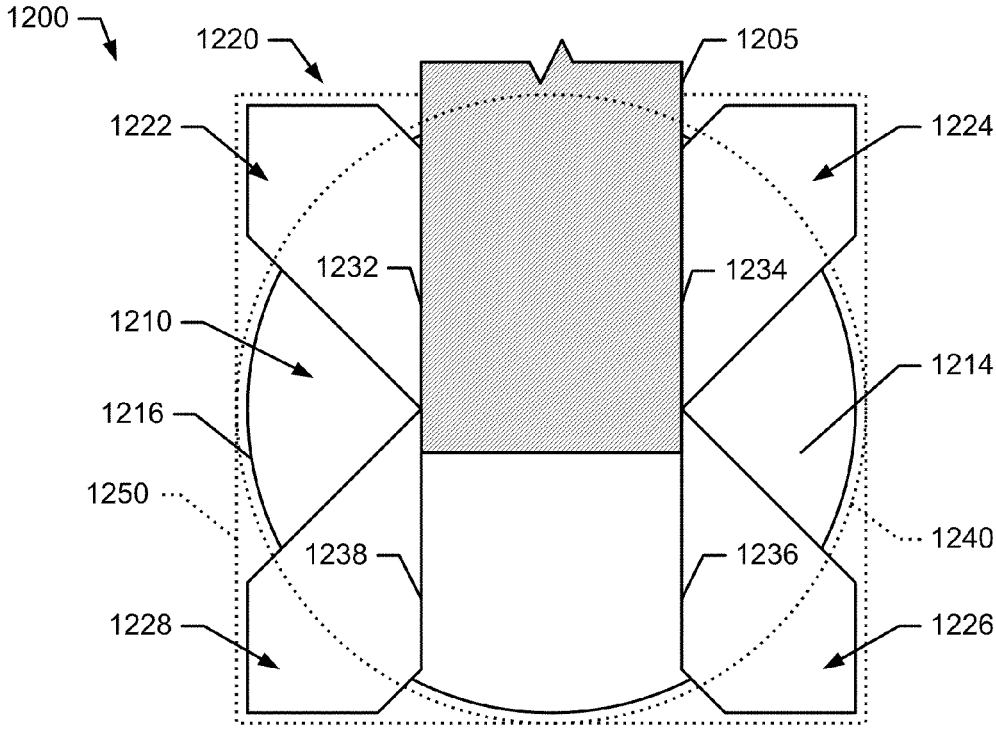
FIG. 12 depicts a bottom view of another example golf bag bottom.

In the example of FIG. 12, a golf bag bottom 1200 may include a base portion 1210 and a plurality of support members 1220, generally shown as 1222, 1224, 1226, and 1228. Each of the plurality of support members 1220 may extend downwardly from the base portion 1210 (e.g., via the outer surface 1214 and/or the side surface 1216). In particular, each of the plurality of support members 1220 may include at least one substantially flat side (e.g., generally shown as a first substantially flat side 1232, a second substantially flat side 1234, a third substantially flat side 1236, and a fourth substantially flat side 1238). In one example, the first support member 1222 may be associated with the first substantially flat side 1232, the second support member 1224 may be associated with the second substantially flat side 1234, the third support member 1226 may be associated with the third substantially flat side 1236, and the fourth support member 1228 may be associated with the fourth substantially flat side 1238. The plurality of support members 1220 (e.g., via the first, second, third, and fourth substantially flat sides 1232, 1234, 1236, and 1238) may form a channel to receive the bag seat member 1205. For example, the first and fourth substantially flat sides 1232 and 1238 may engage a first side of a bag seat member 1105 whereas the second and third substantially flat sides 1234 and 1236 may engage a second side of the bag seat member 1205 in response to the golf bag bottom 1200 sitting on a top surface (e.g., the top surface 1810 of FIG. 18) of the bag seat member 1205.

The base portion 1210 may be associated with a first perimeter 1240 and a second perimeter 1250. Each of the plurality of support members 1220 may extend outwardly from the base portion 1210 (e.g., via the outer surface 1214 and/or the side surface 1216) into an area between the first and second perimeters 1240 and 1250. The methods, apparatus, and articles of manufacture are not limited in this regard.

Figure 13:
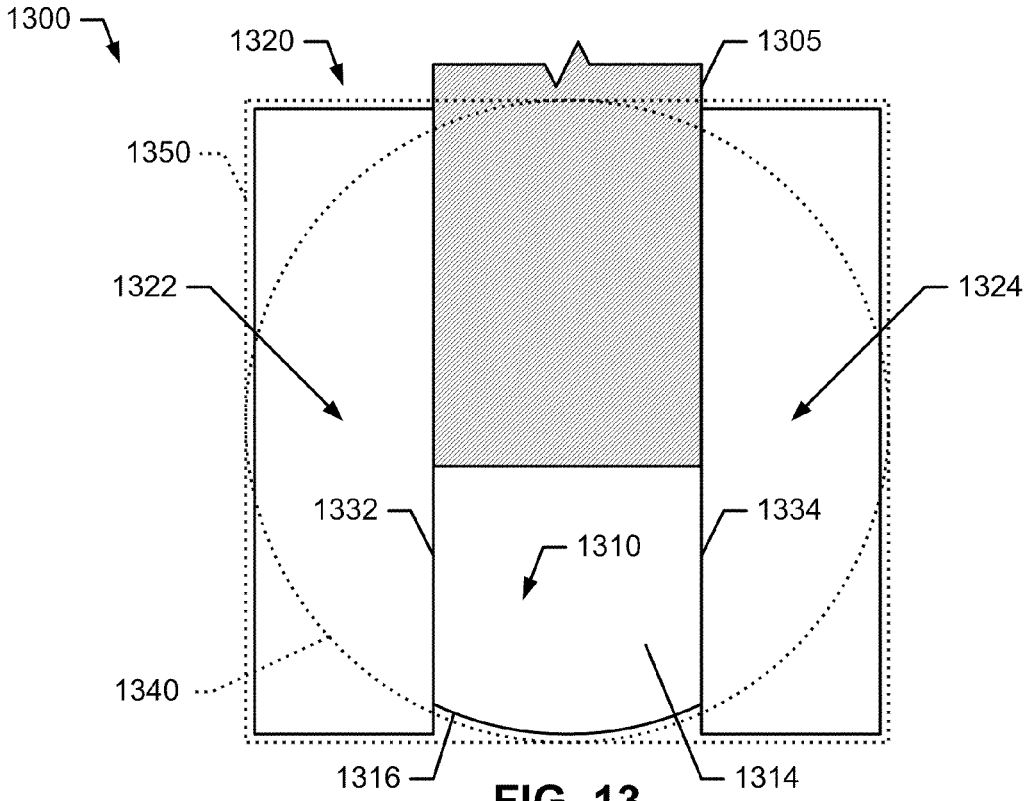
FIG. 13 depicts a bottom view of another example golf bag bottom.

Referring to FIG. 13, for example, a golf bag bottom 1300 may include a base portion 1310 and a plurality of support members 1320, generally shown as 1322 and 1324. Each of the plurality of support members 1320 may extend downwardly from the base portion 1310 (e.g., via the outer surface 1314 and/or the side surface 1316). In particular, each of the plurality of support members 1320 may include a substantially rectangular shape bottom surface. Further, each of the plurality of support members 1320 may include at least one substantially flat side (e.g., generally shown as a first substantially flat side 1332 and a second substantially flat side 1334). In one example, the first support member 1322 may be associated with the first substantially flat side 1332 where as the second support member 1324 may be associated with the second substantially flat side 1334. The plurality of support members 1320 (e.g., via the first and second substantially flat sides 1332 and 1334) may form a channel to receive the bag seat member 1305. For example, the first substantially flat side 1332 may engage a first side of a bag seat member 1305 whereas the second substantially flat side 1334 may engage a second side of the bag seat member 1305 in response to the golf bag bottom 1300 sitting on a top surface (e.g., the top surface 1810 of FIG. 18) of the bag seat member 1305.

The base portion 1310 may be associated with a first perimeter 1340 and a second perimeter 1350. Each of the plurality of support members 1320 may extend outwardly from the base portion 1310 (e.g., via the outer surface 1314 and/or the side surface 1316) into an area between the first and second perimeters 1340 and 1350. The methods, apparatus, and articles of manufacture are not limited in this regard.

Figure 14:
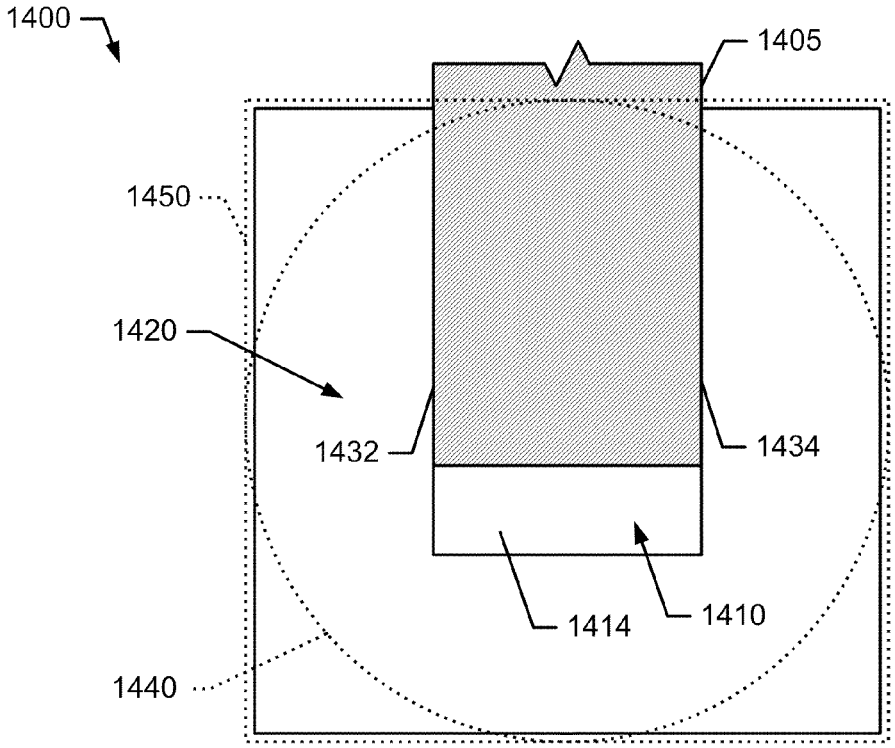
FIG. 14 depicts a bottom view of another example golf bag bottom.

Turning to FIG. 14, for example, a golf bag bottom 1400 may include a base portion 1410 and a support member 1420. The support member 1420 may extend downwardly from the base portion 1410 (e.g., via the outer surface 1414 and/or the side surface (not shown)). In particular, the support member 1420 may include two substantially flat sides (e.g., generally shown as a first substantially flat side 1432 and a second substantially flat side 1434). The support member 1420 (e.g., via the first and second substantially flat sides 1432 and 1434) may form a channel to receive the bag seat member 1305. For example, the first substantially flat side 1432 may engage a first side of a bag seat member 1305 whereas the second substantially flat side 1434 may engage a second side of the bag seat member 1405 in response to the golf bag bottom 1400 sitting on a top surface (e.g., the top surface 1810 of FIG. 18) of the bag seat member 1405.

The base portion 1410 may be associated with a first perimeter 1440 and a second perimeter 1450. The support member 1420 may extend outwardly from the base portion 1410 (e.g., via the outer surface 1414 and/or the side surface 1316) into an area between the first and second perimeters 1440 and 1450. The methods, apparatus, and articles of manufacture are not limited in this regard.

Figure 15:
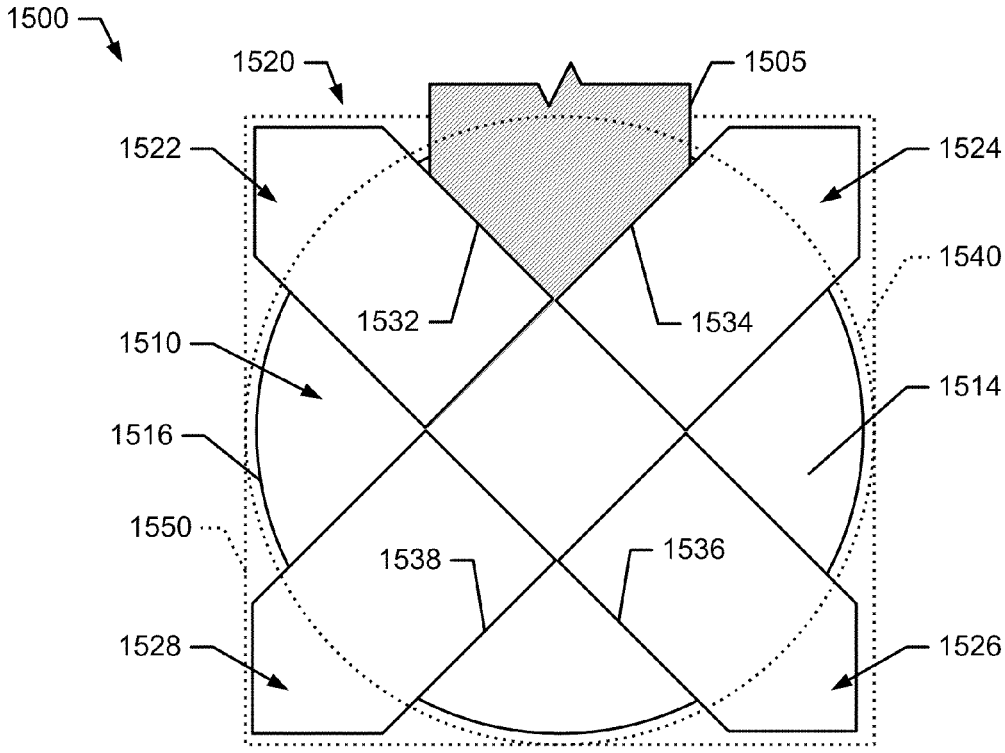
FIG. 15 depicts a bottom view of another example golf bag bottom.
Figure 16:
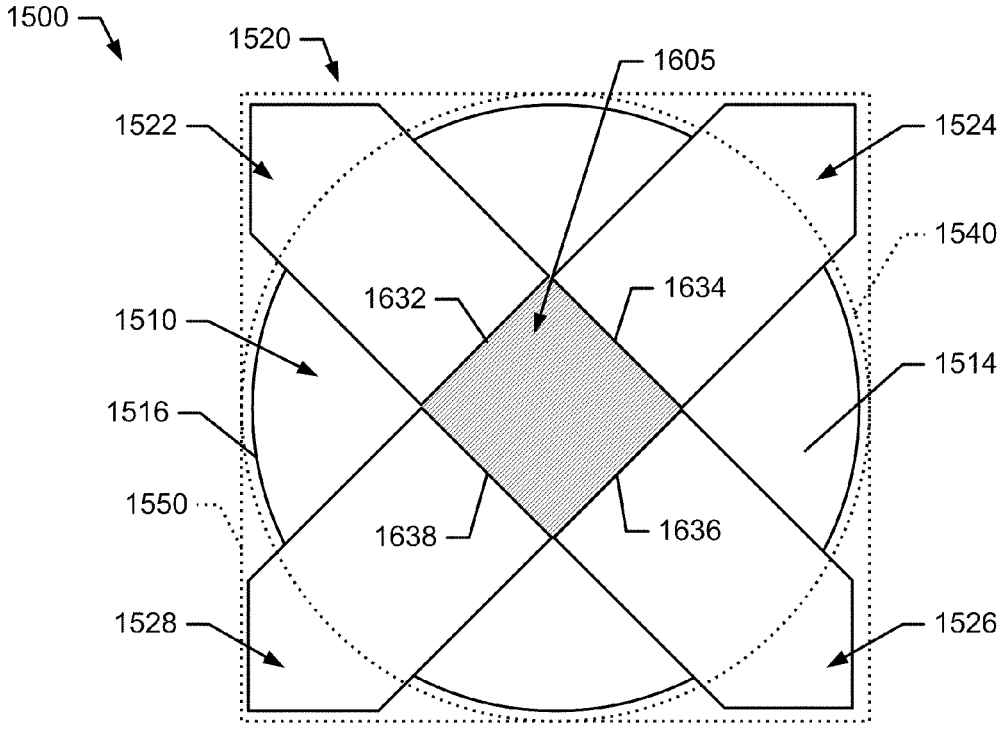
FIG. 16 depicts a bottom view of another example golf bag bottom.

Referring to FIGS. 15 and 16, for example, a golf bag bottom 1500 may include a base portion 1510 and a plurality of support members 1520, generally shown as 1522, 1524, 1526, and 1528. Each of the plurality of support members 1520 may extend downwardly from the base portion 1510 (e.g., via the outer surface 1514 and/or the side surface 1516). In particular, each of the plurality of support members 1520 may include at least one substantially flat side (e.g., generally shown as a first substantially flat side 1532, a second substantially flat side 1534, a third substantially flat side 1536, and a fourth substantially flat side 1538). In one example, the first support member 1522 may be associated with the first substantially flat side 1532, the second support member 1524 may be associated with the second substantially flat side 1534, the third support member 1526 may be associated with the third substantially flat side 1536, and the fourth support member 1528 may be associated with the fourth substantially flat side 1538. The plurality of support members 1520 (e.g., via the first, second, third, and fourth substantially flat sides 1532, 1534, 1536, and 1538) may form a channel to receive the bag seat member 1505. For example, the first substantially flat side 1532 may engage a first side of a bag seat member 1505 whereas the second substantially flat sides 1534 may engage a second side of the bag seat member 1505 in response to the golf bag bottom 1500 sitting on a top surface (e.g., the top surface 1810 of FIG. 18) of the bag seat member 1505.

Although the above examples may depict a particular shape for a bag seat member (e.g., base seat members 705, 1105, 1205, 1305, and 1405 of FIGS. 7, 11, 12, 13, and 14), the base seat member 1505 may have other suitable shapes. In one example, at least a portion of the base seat member 1505 (e.g., an end) may have a substantially triangular shape. In another example, the at least a portion of the base member 1505 may have a substantially round shape. Alternatively as shown in FIG. 16, a base seat member 1605 may have a square shape so that at least one substantially flat side of each of the plurality of support members 1520 may engage the base seat member 1605. In particular, the substantially flat sides 1632, 1634, 1636, and 1638 associated with the plurality of support members 1520 may be engage all four sides of the base seat member 1605 in response to the golf bag bottom 1500 sitting on a top surface of the bag seat member 1605. While the above example may describe a particular shape for the bag seat member 1605, the plurality of support members 1520 may be configured to engage all sides of a triangular shape, a rectangular shape, a pentagonal shape, a hexagonal shape, or any other suitable polygonal shapes.

The base portion 1510 may be associated with a first perimeter 1540 and a second perimeter 1550. Each of the plurality of support members 1520 may extend outwardly from the base portion 1510 (e.g., via the outer surface 1514 and/or the side surface 1516) into an area between the first and second perimeters 1540 and 1550. The methods, apparatus, and articles of manufacture are not limited in this regard.

Although the above examples may depict particular shapes associated with the first and second perimeters, the first and second perimeters may be other suitable shapes. For example, the first perimeter may be a substantially elliptical shape and the second perimeter may be a substantially rectangular shape. The methods, apparatus, and articles of manufacture described herein are not limited in this regard.

Figure 17:
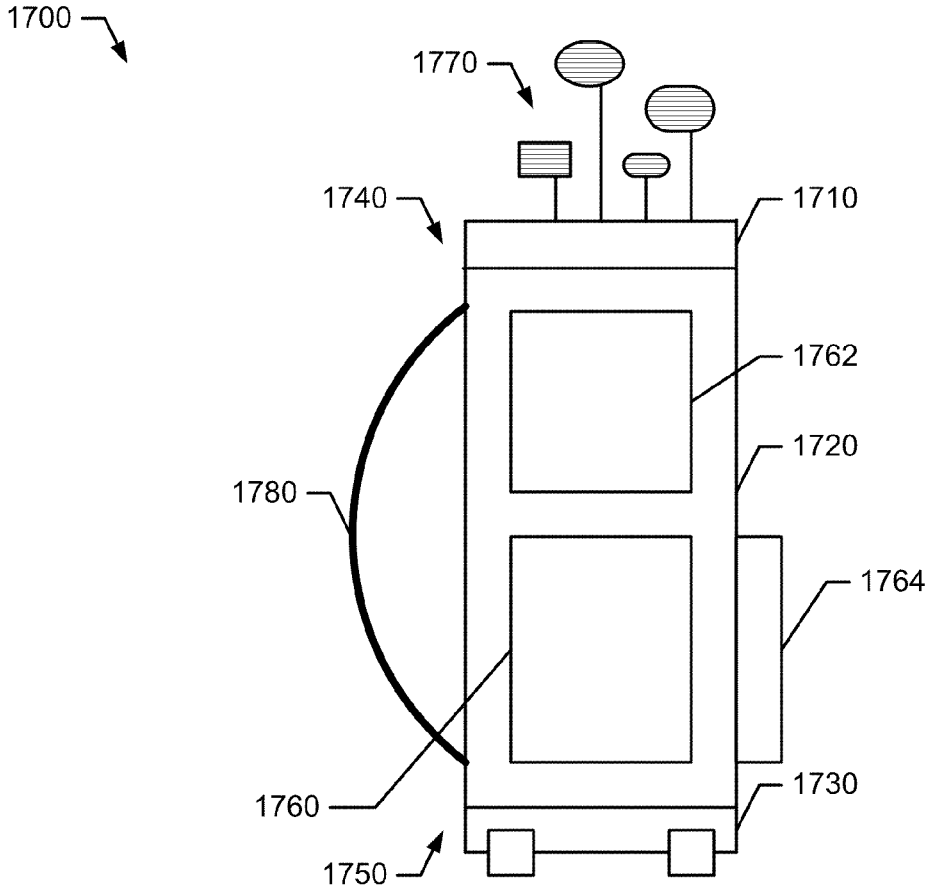
FIG. 17 depicts a side view of an example golf bag.

In the example of FIG. 17, a golf bag 1700 may include a top portion 1710, a body portion 1720, and a bottom portion 1730. The top portion 1710 may be located at a first end 1740 whereas the bottom portion 1730 may be located a second end 1750 opposite of the first end 1740. In one example, the bottom portion 1730 may be the bag bottom 100 (FIGS. 1-6). In another example, the bottom portion 1730 may be the bag bottom 700 (FIGS. 7, 8, 9 and 10). In other examples, the bottom portion 1730 may be any one of the bag bottoms 1100, 1200, 1300, 1400, and 2000 depicted in FIGS. 11, 12, 13, 14, and 20, respectively. The body portion 1720 may be located between the top portion 1610 and the bottom portion 1730. The body portion 1720 may be coupled to the bottom portion 1730 via self-piercing rivets that extend from an extend surface of golf bag 1700, through body portion 1720, through a side surface of bottom portion 1730, and to an interior surface of golf bag 1700. In some examples, an adhesive may also be used to couple the body portion 1720 to the bottom portion 1730. The body portion 1720 may include one or more pockets, storage compartments, or pouches, generally shown as 1760, 1762, and 1764, to store golf ball(s), golf tee(s), personal item(s), water bottle(s), etc. The golf bag 1700 may store one or more golf clubs 1770 within the body portion 1720. The golf club(s) 1770 may be inserted into the golf bag 1700 through the top portion 1710. The golf bag 1700 may also include an adjustable strap 1780 for an individual to carry the golf bag 1700.

Although FIG. 17 may depict an example golf bag with a particular type, shape, and size, the methods, apparatus, and articles of manufacture described herein may be applicable to various type, size, and/or shape of golf bags. For example, the golf bag bottoms described herein may be applicable to cart bags, carry bags, and/or other suitable type of bags. The methods, apparatus, and articles of manufacture described herein are not limited in this regard.

Figure 18:
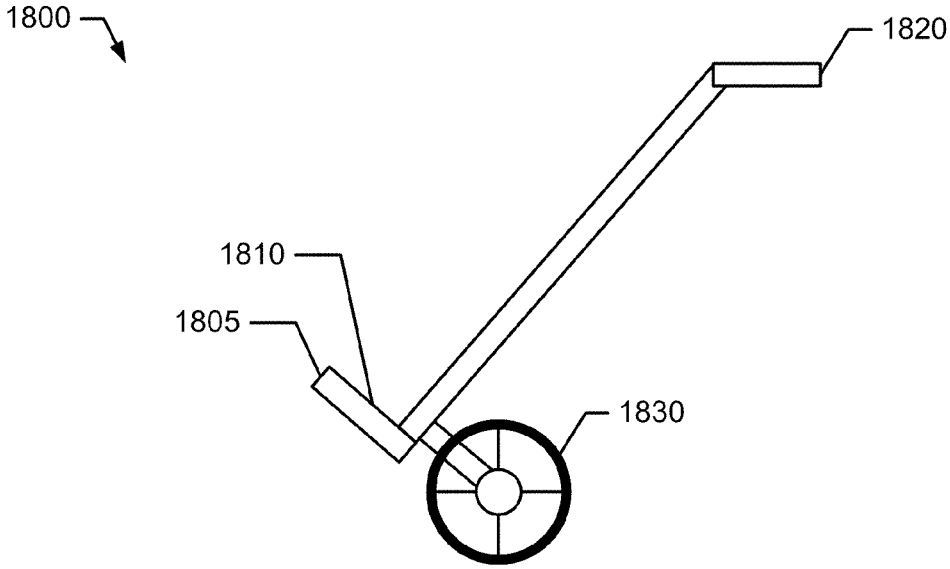
FIG. 18 depicts a side view of a golf bag cart.

Referring to FIG. 18, for example, a golf cart 1800 may include the bag seat member 1805, a hand grip 1820, and one or more wheels, generally shown as 1830. The golf cart 1800 may be a pull cart, a push cart, a motorized cart, and/or any other suitable type of golf carts. In one example, a golf bag (e.g., the golf bag 1700 of FIG. 17) may be placed or sit on a top surface 1810 of the bag seat member 1805. The bag seat member 1805 may be any one of the bag seat members 705 (FIG. 7), 1105 (FIG. 11), 1205 (FIG. 12), 1305 (FIG. 13), 1405 (FIG. 14), and 1505 (FIG. 15) described above or any other bag seat members. Although the above examples may depict particular shapes for the bag seat member, the bag bottoms described herein may be applicable to bag seat members with various shapes (e.g., rectangular, circular, triangular, cross, etc.) or a combination thereof. The methods, apparatus, and articles of manufacture described herein are not limited in this regard.

Figure 19:
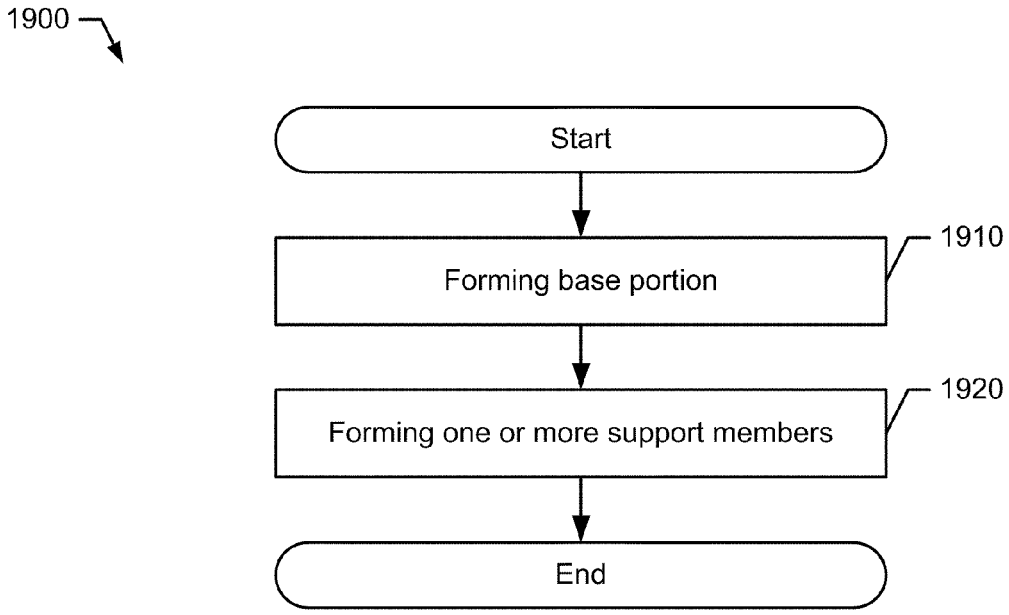
FIG. 19 depicts a flow diagram representation of one manner in which the example golf bag bottom of FIG. 1 may be manufactured.

In the example of FIG. 19, a process 1900 may begin with forming a base portion (e.g., the base portion 110 of FIG. 1) (block 1910). Referring back to FIG. 1, for example, the base portion 110 may include the outer bottom surface 114 and the side surface 116. The base portion 110 may be associated with a first perimeter (e.g., the first perimeter 640 of FIG. 6) and a second perimeter (e.g., the second perimeter 650 of FIG. 6) formed by a plurality of lines tangential to the first perimeter. The first and second perimeters may be associated with a common center. In one example, the first perimeter may be an inscribed circle with a radius whereas the second perimeter may be a square with an apothem equal to the radius.

Turning back to FIG. 19, the process 1900 may form one or more support members (block 1920). In particular, the support member(s) may extend downwardly from the base portion and outwardly from the base portion into an area between the first and second perimeters. For example, the support member(s) may extend downwardly from the outer surface of the base portion and outwardly from the side surface of the base portion. The support member(s) may include at least two substantially flat sides to engage at least a portion of a bag seat member associated with a cart, a bag stand, or a bag rack.

Figure 20:
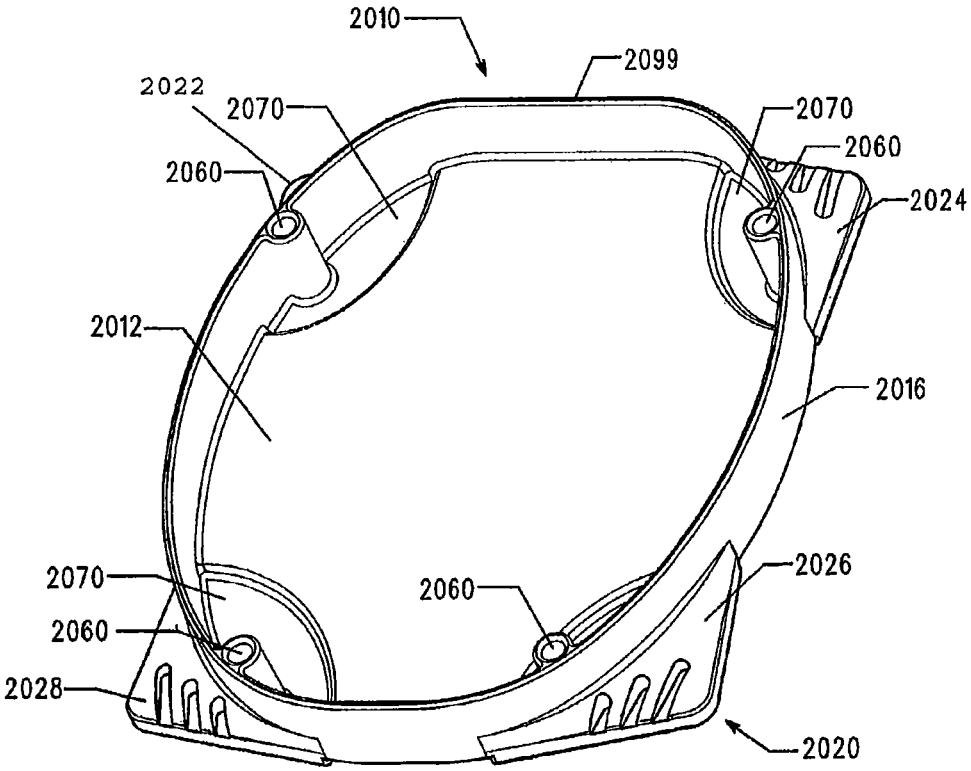
FIG. 20 depicts a perspective diagram representation of another example golf bag bottom.
Figure 21:
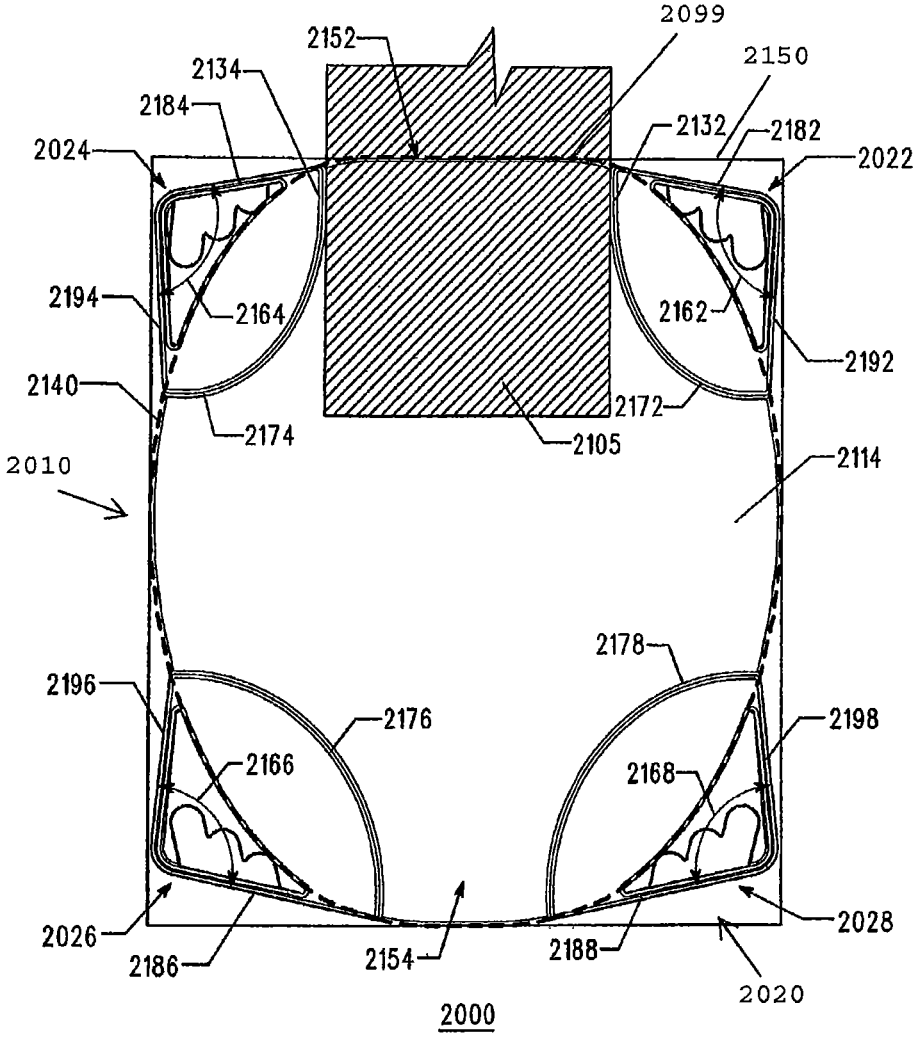
FIG. 21 depicts a bottom view of the example golf bag bottom of FIG. 20.

Turning to FIGS. 20 and 21, another example of a golf bag bottom is illustrated. Golf bag bottom 2000 can be attached to a golf bag, such as, for example, golf bag 1600 (FIG. 16). Golf bag bottom 2000 can include a base portion 2010. Base portion 2010 can include: a bottom with an inner surface 2012 (FIG. 20) and an outer surface 2114 (FIG. 21), both of which are substantially flat; and a side surface 2016 (FIG. 20). As an example, base portion 2010 can have a circular shape. The circular shape can be an exact circular shape or a substantially circular shape; and a substantially circular shape can include an oval or an egg shape. In the example of FIG. 20, base 2010 has an egg shape. In addition, base 2010 can have one or more portions that are substantially linear, such as, for example, portion 2099, while maintaining its substantially circular shape and/or egg shape. In other examples, base 2010 can also be substantially rectangular with rounded corners.

As illustrated in FIG. 21, there are two different perimeters associated with golf bag bottom 2000. For example, golf bag bottom 2000 can have a first perimeter 2140 and a second perimeter 2150. First perimeter 2140 can have a shape that is the same as the perimeter of side surface 2016 (FIG. 20). Second perimeter 2150 can have a shape that is a quadrilateral. Second perimeter 2150 is formed by intersecting four lines that are tangential to first perimeter 2140. As used herein, the meaning of the term "tangential" includes the ordinary meaning of the term, as well as a line that is colinear with another line or surface. For example, second perimeter 2150 is tangential to substantially linear portion 2099. In the example illustrated in FIG. 21, second perimeter 2150 is a rectangle. In another embodiment, second perimeter 2150 is a square.

Golf bag bottom 2000 can also include a plurality of support members 2020. As an example, support members 2020 can include support members 2022, 2024, 2026, and 2028. Support members 2020 extend downwardly and away from outer surface 2114 of base portion 2010 and outwardly and away from side surface 2016 between first perimeter 2140 and second perimeter 2150. In some examples, each of support members 2020 extend approximately 0.38 cm below outer surface 2114. In other examples, support members 2020 extend approximately 0.64, 0.51, 0.25, or 0.13 cm below outer surface 2114. Support members provide stability to a golf bag when a golf bag is set in an upright position. Therefore, the surface area of support members 2020 can be made as large as possible to provide greater stability. The golf bag, however, should also be able to fit in a golf cart, and support members 2020 should not be so large that: (1) the golf bag will not fit in the golf cart; or (2) support members 2020 overlap support members or other portions of an adjacent golf bag in the golf cart. Accordingly, support members 2020 can remain entirely within second perimeter 2150. In addition, to increase stability, support members 2020 can be positioned proximate to the corners of the quadrilateral shape of second perimeter 2150.

In other embodiments, support members 2020 can extend beyond second perimeter 2150. Some countries, such as, for example, Japan, have different golf bag supports in golf carts such that the spatial requirement of maintaining support members 2020 within second perimeter 2150 is not necessary.

Support members can be any shape that provides stability to the golf bag. As illustrated in FIG. 21, support members 2020 can include three sides, namely, two sides that are substantially linear, and one side that is substantially curved. As an example, support member 2022 can include two linear sides 2182 and 2192, and can include curved side 2172. As another example, support member 2028 can include linear sides 2188 and 2198, and can include curved side 2178. In other examples, one or more support members fill the entire region between first perimeter 2140 and second perimeter 2150.

The two linear sides of support members 2020 extend outwards from side surface 2016 between first perimeter 2140 and second perimeter 2150. In addition, the curved side of support members 2020 is located inside first perimeter 2140 and extends inwardly from outside surface 2016. The two linear sides of support members 2020 connect to form an angle between the two sides. In some embodiments, this angle is greater than 90° (ninety degrees) to increase the surface area of support members 2020. In the same or different embodiments, angles 2162 and 2164, which are adjacent substantially linear portion 2099 (FIG. 20) can be smaller than angles 2166 and 2168. For example, angles 2162 and 2164 can be approximately 96°, and angles 2166 and 2168 can be approximately 97°. In other examples, the angle between the two linear sides of support members 2020 is less than or equal to 90°.

In some examples, support members 2022 and 2024 are symmetric with each other, so that side 2184 is similar to side 2182, side 2194 is similar to side 2192, and side 2174 is similar to side 2172. In the same or different examples, support members 2026 and 2028 are symmetric with each other, so that side 2186 is similar to side 2188, side 2196 is similar to side 2198, and side 2176 is similar to side 2178. In further examples, support members 2022 and 2024 are asymmetric with support members 2026 and 2028.

Support members 2020 can also be configured to engage with various objects with a bag seat member, such as, for example, a golf cart, a bag stand, bag racks, etc. At least two of support members 2020 can be configured to interact with bag seat member 2105, which can be similar to bag seat member 705 (FIG. 7). In some embodiments, two of support members 2020 can have a substantially linear portion on their respective curved sides. For example, support member 2022 can have linear portion 2132 in curved side 2172; and support member 2024 can have linear portion 2134 in curved side 2174. Linear portions 2132 and 2134 are substantially parallel to one another, thereby forming channel 2152 between linear portions 2132 and 2134. In some examples, each of linear portions 2132 and 2134 are approximately 2.54 cm in length. In other examples, each of linear portions 2132 and 2134 are approximately 1.91, 1.27, or 0.64 cm in length. In yet other examples, each of linear portions 2132 and 2134 are greater than 2.54 cm in length. Bag seat member 2105 can fit complementarily in channel 2152, thereby providing more stability for a golf bag when engaged with a golf cart, golf bag stand, bag rack, and the like.

In addition, space 2154 exists between support member 2028 and support member 2026. In some examples, the width of space 2154 is less than channel 2152. In other examples, the width of space 2154 is greater than or equal to the width of channel 2152 to provide more support for the golf bag. In the same or different examples, the distance between support member 2022 and support member 2028 is equal to the distance between support member 2024 and support member 2026.

Support members 2020 can be integral with base portion 2010. In some examples, the thickness of the bottom of base portion 2010 and support members 2020 are equal and approximately constant. A constant thickness allows for more efficient manufacturing. To have a constant thickness between the bottom base portion 2010 and support members 2020, recesses 2070 (FIG. 20) can be created in the bottom of base portion 2010 where support members 2020 extend downwardly from outer surface 2114 (FIG. 21). The depth of recesses 2070 can be equal to the distance that support members 2020 extend from outer surface 2114, thereby maintaining a constant thickness in the bottom of base portion 2010 and support members 2020. In addition, recesses 2070 allow the grips of any golf clubs placed in the golf bag to stay away from any moisture or water that enters into the golf bag. The moisture may accumulate in recesses 2070, thereby keeping the grips of the golf clubs dry.

Base portion 2010 can also comprise slots 2060. Slots 2060 allow rods or stays to be inserted into base portion 2010 of bag bottom 2000. The rods (not shown) help define the external shape of the golf bag between bag bottom 2000 and the top portion or top opening of the golf bag. A fabric, leather, or other material is placed around the rods and circumscribing outside surface 2016, thereby helping define the shape of the bag.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A bag bottom comprising:

a base portion having an outer bottom surface, a side surface, and a first perimeter defined by the side surface, wherein a second perimeter is defined by a plurality of contiguous lines tangential to the first perimeter; and four support members extending downwardly from the outer bottom surface and extending outwardly from the side surface between the first and second perimeters, wherein at least two of the four support members form a channel to engage at least a portion of a bag seat member associated with at least one of a cart, a bag stand, or a bag rack;

wherein:

each of the four support members comprises two substantially linear sides located outside of the first perimeter and a curved side located within the first perimeter and extending inwardly from the side surface such that the at least two of the four support members form the channel;

the four support members comprise:

a first support member;

a second support member;

a third support member; and a fourth support member;

the first support member and the second support member are symmetric with each other;

the third support member and the fourth support member are symmetric with each other;

the first support member and the second support member each comprise a substantially linear portion at the curved side; and the substantially linear portion of the curved side of the first support member and the substantially linear portion of the curved side of the second support member are parallel to each other, form the channel, and are configured to engage the at least the portion of the bag seat member associated with the at least one of the cart, the bag stand, or the bag rack.

2. The bag bottom of claim 1, wherein:

the first perimeter comprises a substantially circular perimeter.

3. The bag bottom of claim 2, wherein:

the substantially circular perimeter comprises an egg shape perimeter.

4. The bag bottom of claim 1, wherein:

the second perimeter comprises a quadrilateral perimeter comprising four lines tangent to the first perimeter, the plurality of contiguous lines comprising the four lines tangent to the first perimeter.

5. The bag bottom of claim 4, wherein:

a different one of the four support members is located proximate each corner of the quadrilateral perimeter.

6. The bag bottom of claim 1, wherein:

the two substantially linear sides of the first support member connect to form a first angle that is greater than 90 degrees;

the two substantially linear sides of the second support member connect to form a second angle that is greater than 90 degrees;

the two substantially linear sides of the third support member connect to form a third angle that is greater than 90 degrees; and the two substantially linear sides of the fourth support member connect to form a fourth angle that is greater than 90 degrees.

7. The bag bottom of claim 6, wherein:

the first and second angles are the same; and the third and fourth angles are the same.

8. The bag bottom of claim 6, wherein:

the first and second angles are smaller than the third and fourth angles.

9. The bag bottom of claim 1, wherein:

a first distance separates the first support member and the second support member;

a second distance separates the third support member from the fourth support member; and the first distance is greater than the second distance.

10. The bag bottom of claim 9, wherein:

the first perimeter comprises an egg shape perimeter;

the egg shape perimeter comprises a substantially linear perimeter portion; and the substantially linear perimeter portion is located between the first support member and the second support member.

11. The bag bottom of claim 1, wherein:

the first perimeter comprises one or more substantially linear perimeter portions.

12. The bag bottom of claim 1, wherein:

the first perimeter comprises a substantially circular perimeter;

the substantially circular perimeter comprises an egg shape perimeter;

the second perimeter comprises a quadrilateral perimeter comprising four lines tangent to the first perimeter, the plurality of contiguous lines comprising the four lines tangent to the first perimeter;

a different one of the four support members is located proximate each corner of the quadrilateral perimeter;

the two substantially linear sides of the first support member connect to form a first angle that is greater than 90 degrees;

the two substantially linear sides of the second support member connect to form a second angle that is greater than 90 degrees;

the two substantially linear sides of the third support member connect to form a third angle that is greater than 90 degrees;

the two substantially linear sides of the fourth support member connect to form a fourth angle that is greater than 90 degrees;

the first and second angles are the same;

the third and fourth angles are the same;

a first distance separates the first support member and the second support member;

a second distance separates the third support member from the fourth support member;

the first distance is greater than the second distance;

the egg shape perimeter comprises a substantially linear perimeter portion; and the substantially linear perimeter portion is located between the first support member and the second support member.

13. The bag bottom of claim 1, wherein:

the substantially linear portion of the curved side of the first support member and the substantially linear portion of the curved side of the second support member are each greater than or equal to approximately 2.54 centimeters in length.

14. A golf bag, comprising:

a top portion having one or more openings to receive one or more golf clubs;

a body portion coupled to the top portion to store the one or more golf clubs; and a bottom portion coupled to the body portion, the bottom portion having four support members, wherein:

the bottom portion has a side surface defining an inner perimeter;

the four support members extend downwardly from the bottom portion and extend outwardly from the bottom portion between the inner perimeter and an outer perimeter;

the outer perimeter comprises a quadrilateral shape defined by four lines tangent to the inner perimeter;

at least two of the four support members form a channel to engage at least a portion of a bag seat member associated with at least one of a cart, a bag stand, or a bag rack;

the four support members comprise:

a first support member;

a second support member;

a third support member; and a fourth support member;

the third support member and the fourth support member are symmetric with each other;

the first support member and the second support member are asymmetric to the third support member and the fourth support member;

each of the four support members comprises two substantially linear sides and a curved side extending inwardly from the side surface such that the at least two of the four support members form the channel;

the first support member and the second support member each comprise a substantially linear portion at the curved side; and the substantially linear portion of the curved side of the first support member and the substantially linear portion of the curved side of the second support member are parallel to each other, form the channel, and are configured to engage the at least the portion of the bag seat member associated with the at least one of the cart, the bag stand, or the bag rack.

15. The golf bag of claim 14, wherein:

the inner perimeter comprises an egg shape perimeter.

16. The golf bag of claim 14, wherein:

the inner perimeter comprises a rectangular shape with rounded corners.

17. The golf bag of claim 14, wherein:

the two substantially linear sides of the first support member connect to form a first angle that is greater than 90 degrees;

the two substantially linear sides of the second support member connect to form a second angle that is greater than 90 degrees;

the two substantially linear sides of the third support member connect to form a third angle that is greater than 90 degrees; and the two substantially linear sides of the fourth support member connect to form a fourth angle that is greater than 90 degrees.

18. The golf bag of claim 17, wherein:

the first and second angles are the same; and the third and fourth angles are the same.

19. The golf bag of claim 17, wherein:

the first and second angles are smaller than the third and fourth angles.

20. The golf bag of claim 14, wherein:

the inner perimeter comprises an egg shape perimeter;

the egg shape perimeter comprises a substantially linear perimeter portion; and the substantially linear perimeter portion is located between the first support member and the second support member.

21. The golf bag of claim 14, wherein:

the inner perimeter comprises a substantially circular perimeter;

the two substantially linear sides of the first support member connect to form a first angle that is greater than 90 degrees;

the two substantially linear sides of the second support member connect to form a second angle that is greater than 90 degrees;

the two substantially linear sides of the third support member connect to form a third angle that is greater than 90 degrees;

the two substantially linear sides of the fourth support member connect to form a fourth angle that is greater than 90 degrees;

the first and second angles are the same; and the third and fourth angles are the same.

22. The golf bag of claim 14, wherein:

the substantially linear portion of the curved side of the first support member and the substantially linear portion of the curved side of the second support member are each greater than or equal to approximately 2.54 centimeters in length.

23. A bag bottom comprising:

a base portion having an outer bottom surface, a side surface, and a first perimeter defined by the side surface, wherein a second perimeter is defined by a plurality of contiguous lines tangential to the first perimeter; and four support members extending downwardly from the outer bottom surface and extending outwardly from the side surface between the first and second perimeters, wherein at least two of the four support members form a channel to engage at least a portion of a bag seat member associated with at least one of a cart, a bag stand, or a bag rack;

wherein:

each of the four support members comprises two substantially linear sides located outside of the first perimeter and a curved side located within the first perimeter and extending inwardly from the side surface such that the at least two of the four support members form the channel;

the four support members comprise:

a first support member;

a second support member;

a third support member; and a fourth support member;

the first perimeter comprises an egg shape perimeter;

the egg shape perimeter comprises a substantially linear perimeter portion;

the substantially linear perimeter portion is located between the first support member and the second support member;

the first support member and the second support member are symmetric with each other;

the third support member and the fourth support member are symmetric with each other;

the first support member and the second support member each comprise a substantially linear portion at the curved side; and the substantially linear portion of the curved side of the first support member and the substantially linear portion of the curved side of the second support member are parallel to each other, form the channel, and are configured to engage the at least the portion of the bag seat member associated with the at least one of the cart, the bag stand, or the bag rack.

24. The bag bottom of claim 23, wherein:

the two substantially linear sides of the first support member connect to form a first angle that is greater than or equal to 90 degrees;

the two substantially linear sides the second support member connect to form a second angle that is greater than or equal to 90 degrees;

the two substantially linear sides the third support member connect to form a third angle that is greater than or equal to 90 degrees; and the two substantially linear sides the fourth support member connect to form a fourth angle that is greater than or equal to 90 degrees.

25. The bag bottom of claim 24, wherein:

the first and second angles are the same; and the third and fourth angles are the same.

26. The bag bottom of claim 24, wherein:

the first and second angles are smaller than the third and fourth angles.

27. The bag bottom of claim 23, wherein:

the base portion further comprises an inner surface; and the inner surface comprises recesses where the four support members extend downwardly from the outer bottom surface.

28. The bag bottom of claim 23, wherein:

the four support members comprise a constant thickness.

29. The bag bottom of claim 23, wherein:

the two substantially linear sides of the first support member connect to form a first angle that is greater than 90 degrees;

the two substantially linear sides of a the second support member connect to form a second angle that is greater than 90 degrees;

the two substantially linear sides of the third support member connect to form a third angle that is greater than 90 degrees;

the two substantially linear sides of the fourth support member connect to form a fourth angle that is greater than 90 degrees;

the first and second angles are the same; and the four support members comprise a constant thickness.

30. The bag bottom of claim 23, wherein:

the substantially linear portion of the curved side of the first support member and the substantially linear portion of the curved side of the second support member are each greater than or equal to approximately 2.54 centimeters in length.

* * * * *